US008287321B2

(12) United States Patent
Facco et al.

(10) Patent No.: US 8,287,321 B2
(45) Date of Patent: Oct. 16, 2012

(54) ELECTRICAL CONNECTION ELEMENT WITH THIN CONNECTORS AND ELECTRICAL CONNECTION USING SAID CONNECTION ELEMENT

(75) Inventors: Danilo Facco, Vigodarzere (IT); Francesco Artuso, Albignasego (IT); Moreno Franco, Padua (IT)

(73) Assignee: Viemme s.r.l., Limena (PD) (IT)

( * ) Notice: Subject to any disclaimer, the term of this patent is extended or adjusted under 35 U.S.C. 154(b) by 0 days.

(21) Appl. No.: 13/120,029

(22) PCT Filed: Oct. 7, 2009

(86) PCT No.: PCT/IB2009/007061

§ 371 (c)(1), (2), (4) Date: Apr. 21, 2011

(87) PCT Pub. No.: WO2010/041124

PCT Pub. Date: Apr. 15, 2010

(65) Prior Publication Data

US 2011/0189903 A1 Aug. 4, 2011

(30) Foreign Application Priority Data

Oct. 9, 2008 (IT) ..... VI2008A0234

(51) Int. Cl.
*H01R 13/11* (2006.01)

(52) U.S. Cl. ..... 439/850

(58) Field of Classification Search ..... 439/839–860
See application file for complete search history.

(56) References Cited

U.S. PATENT DOCUMENTS

| | | | | | |
|---|---|---|---|---|---|
| 4,740,180 | A * | 4/1988 | Harwath et al. | ..... | 439/856 |
| 4,943,248 | A * | 7/1990 | Colleran et al. | ..... | 439/850 |
| 5,167,544 | A * | 12/1992 | Brinkman et al. | ..... | 439/856 |
| 5,290,181 | A * | 3/1994 | Bixler et al. | ..... | 439/856 |
| 5,676,570 | A * | 10/1997 | Scherer | ..... | 439/787 |
| 5,929,740 | A * | 7/1999 | Oh et al. | ..... | 337/198 |
| 6,027,361 | A * | 2/2000 | Burmeister et al. | ..... | 439/395 |
| 7,892,050 | B2 * | 2/2011 | Pavlovic et al. | ..... | 439/839 |
| 2006/0073741 | A1 * | 4/2006 | Bommersheim | ..... | 439/850 |
| 2006/0094305 | A1 | 5/2006 | Masaki et al. | | |
| 2007/0249240 | A1 * | 10/2007 | Chiang | ..... | 439/850 |

FOREIGN PATENT DOCUMENTS

| | | | |
|---|---|---|---|
| DE | 3116731 | A1 | 11/1982 |
| DE | 102004024790 | A1 | 12/2005 |
| EP | 1329925 | A | 7/2003 |
| GB | 1018909 | A | 2/1966 |

* cited by examiner

*Primary Examiner* — Briggitte R Hammond
(74) *Attorney, Agent, or Firm* — IP Strategies

(57) ABSTRACT

Electrical connection element (1; 21; 31) of the type comprising: a male thin connector (2; 22; 32); a female thin connector (3; 23; 33) in which it is possible to identify a fork (4) having two shaped arms (5, 6) that define a slit (7) for the insertion of the male thin connector (2; 22; 32) in order to obtain the electrical contact. A bridge element (8) connects the shaped elements (5, 6) to each other.

21 Claims, 10 Drawing Sheets

ELECTRICAL CONNECTION ELEMENT WITH THIN CONNECTORS AND ELECTRICAL CONNECTION USING SAID CONNECTION ELEMENT

FIELD OF THE INVENTION

The present invention concerns an electrical connection element with thin connectors and an electrical connection using one or more of the above mentioned electrical connection elements.

In particular, the connection element that is the subject of the invention is suited to make electrical connections for connecting the ends of single leads or electrical connections for connecting two leads to a microfuse.

BACKGROUND OF THE INVENTION

Connection elements are known which comprise male thin connectors inserted in corresponding properly shaped female thin connectors, in which the electrical contact is guaranteed by the elastic pressure that is produced between the thin elements once they have been coupled.

Connection elements of the type described above are used to make electrical connections of the "fast-on" type, or electrical connections for microfuses used mainly in motor vehicles.

According to a known construction form, the connection element substantially comprises a male thin connector and a female thin connector shaped like a fork, suited for the insertion of the male thin connector through interference.

If the connection element serves to make a connection intended to obtain electrical continuity between the ends of leads, both thin elements are provided with means for connection to the ends of the leads themselves, for example crimping blades.

On the other end, to obtain a connection for microfuses two connection elements are used, wherein each of the two female thin connectors is connected to the end of a lead, while the two male thin connectors constitute the ends of the microfuse.

According to the known art, the connection elements are obtained from a thin metal sheet through a shearing and bending operation, which allows them to be produced in a single piece and in large quantities, thus limiting production costs.

The connection elements of the type described, however, pose the recognized drawback that they do not guarantee the stability of the coupling of the connectors over time.

In fact, with prolonged use we have a progressive opening of the arms of the fork obtained in the female thin connector and therefore a progressive decrease in the stability of the connection between the connectors, with consequent deterioration of the electrical contact.

The resulting drawback lies first of all in the reduction of the current that can be transmitted and therefore in increased losses.

Furthermore, the instability of the contact causes also the overheating of the connection element.

Finally, if the instability of the contact is considerable, in the presence of vibrations these may even cause the joint to open due to the separation of the connectors, a risk that is all but remote, especially if the connection element is used to make electrical connections installed on motor vehicles.

The drawbacks described above arise because the metallic material of which the connectors are made must necessarily have optimal electrical conductivity characteristics, but does not always have optimal elasticity characteristics.

In order to overcome said drawback, electrical connection elements have been developed which are provided with thin connectors in which the arms making up the fork of the female thin connector are associated with a steel shaped body that serves as a spring.

In this way the stability over time of the contact force between the shaped arms of the fork and the male thin connector is guaranteed by the force exerted by the steel spring, while transmission of the electric current is guaranteed by the conductivity features of the material with which the thin connector elements are made.

This type of solution obviously involves higher production costs, due to the presence of the additional component which is the steel shaped body.

Furthermore, production costs are higher also due to the cost of the coupling between the steel shaped body and the female thin connector.

BRIEF SUMMARY OF THE INVENTION

As a whole, therefore, the joining element has a higher selling price than the known equivalent joining elements that are not provided with the steel spring.

Finally, the presence of an additional component requires even a higher investment for making the necessary moulds and assembly equipment.

The present invention aims to overcome the drawbacks listed above.

In particular, it is a first object of the invention to develop an electrical connection element of the type with thin connectors, in which the female thin connector is made in a single piece and features a degree of elasticity at least equal to that of female thin connectors provided with a steel elastic element.

It is another object of the invention to develop a connection element capable of maintaining its elasticity in such a way as to ensure constantly good electrical contact over time and notwithstanding the prolonged use.

It is a further object of the invention to propose an electrical connection element whose production costs are lower than those of electrical connections provided with a steel elastic element.

The objects described above are achieved through the construction of an electrical connection element whose characteristics are described in the main claim, to which the reader should refer for the sake of brevity.

Other characteristics of the connection element that is the subject of the invention are described in the dependent claims.

Advantageously, the electrical connection element that is the subject of the invention makes it possible to combine the higher elasticity of the composite connection elements provided with steel elastic element and the lower cost and simpler construction of the electrical connection elements provided with a female thin lead in a single piece.

BRIEF DESCRIPTION OF THE DRAWINGS

Still advantageously, the electrical connection element of the invention can be obtained by means of the same shearing and bending techniques employed for making the connection elements with thin connectors of known type.

The aims and advantages described above will be highlighted in greater detail in the descriptions of preferred embodiments of the invention that are supplied as indicative, non-limiting examples with reference to the enclosed drawings, wherein.

DETAILED DESCRIPTION OF THE INVENTION

Figure 1:
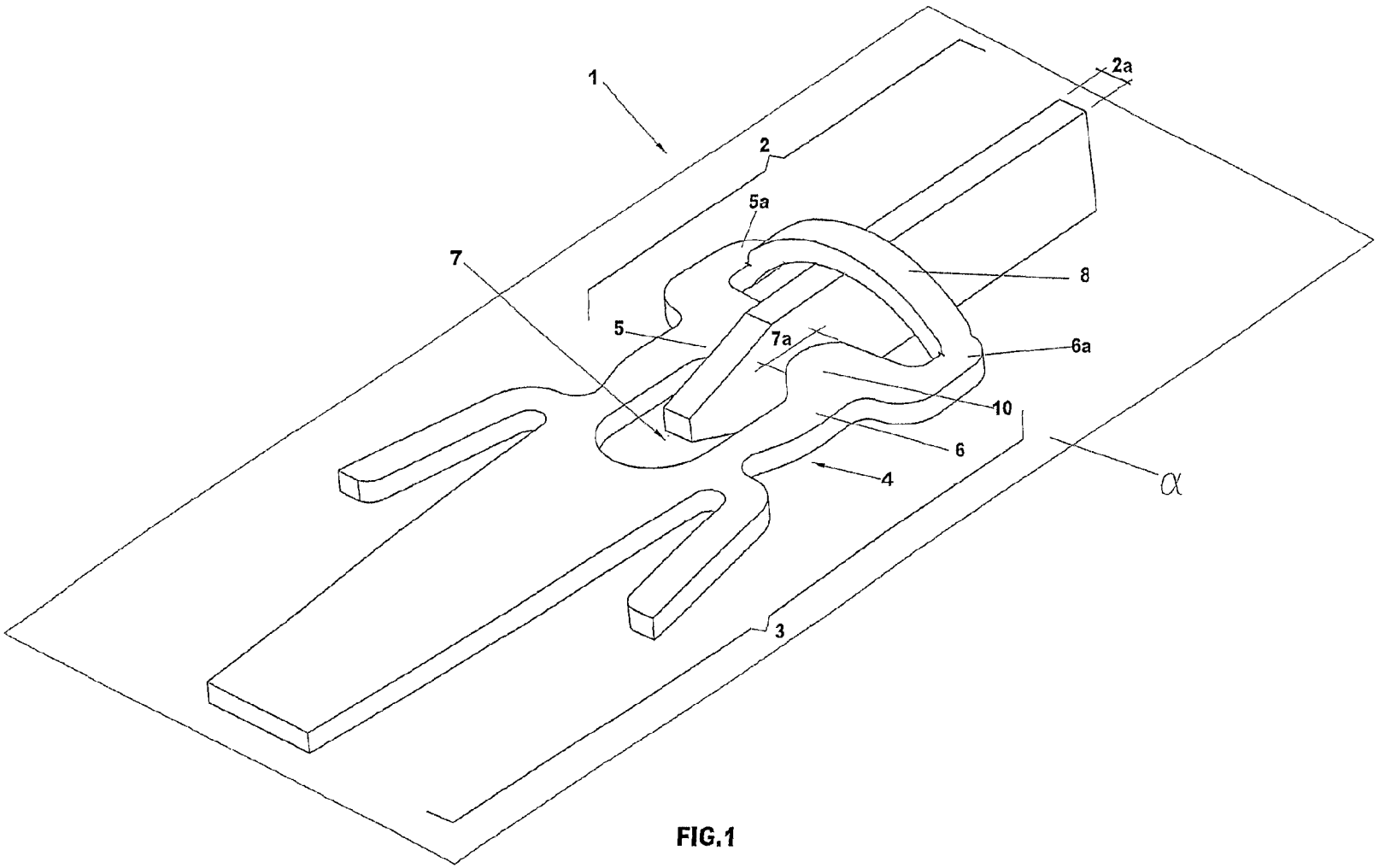
FIGS. 1 and 2 show two different axonometric views of the electrical connection element that is the subject of the invention.
Figure 2:
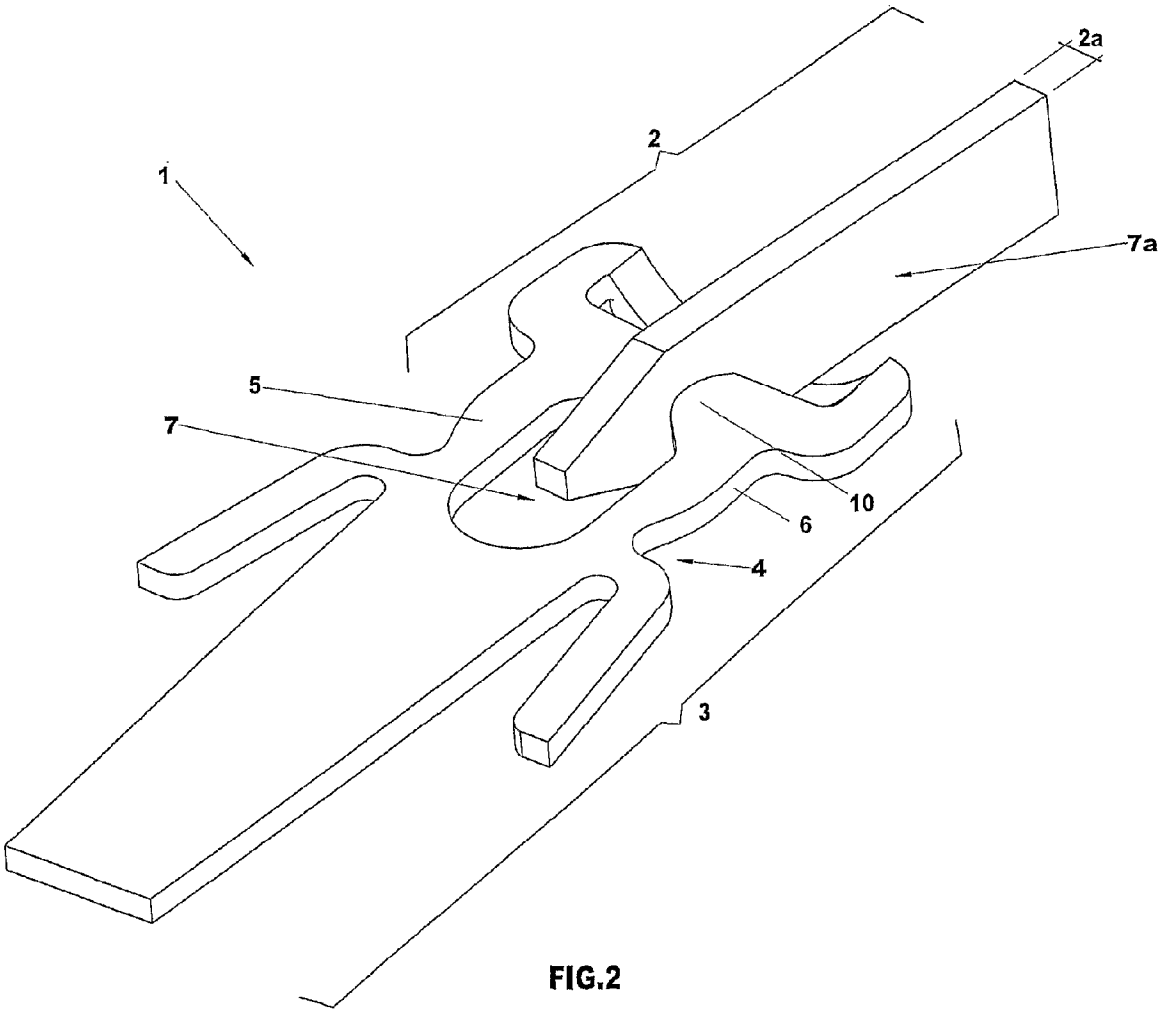
Figure 3:
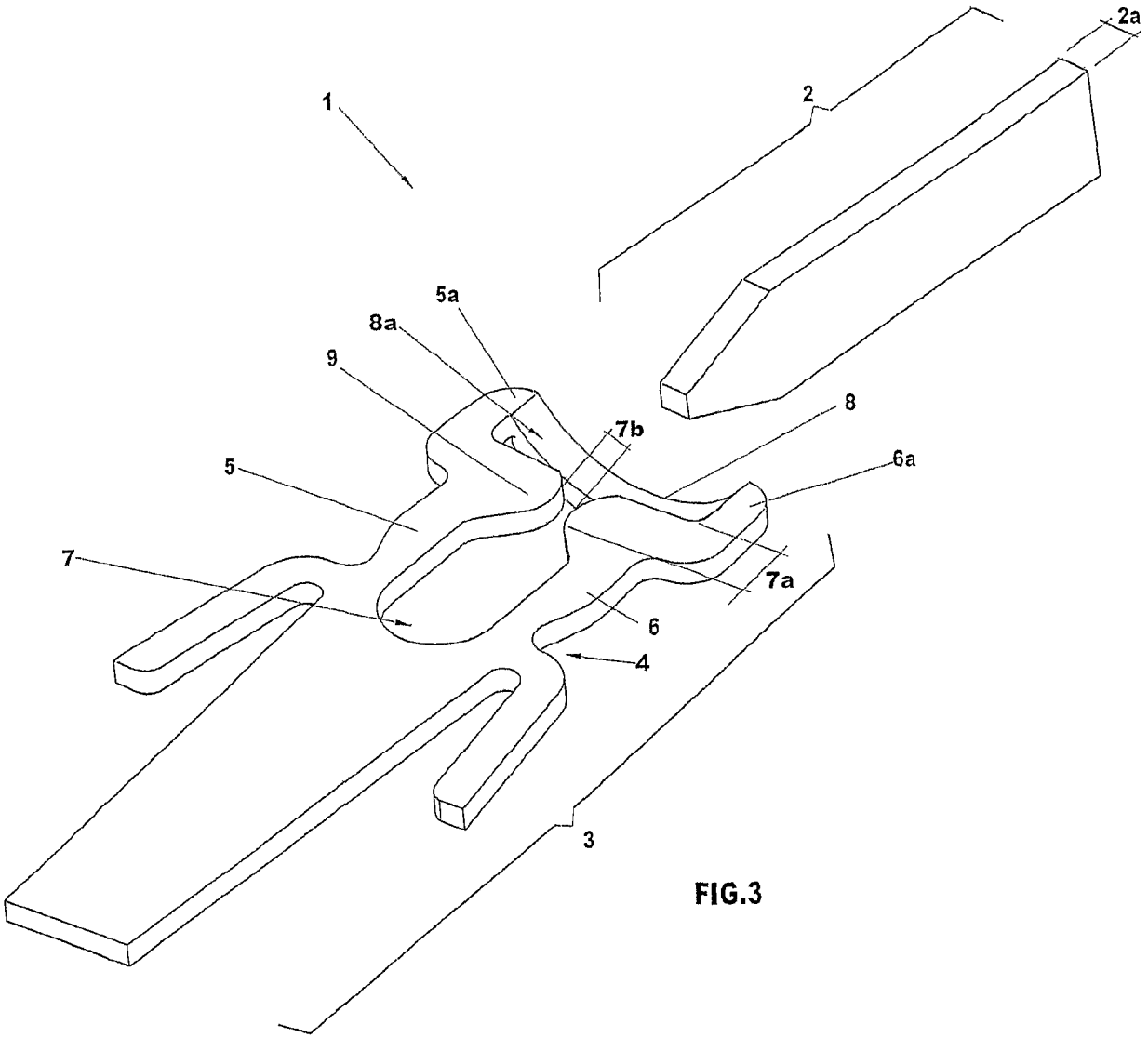
FIG. 3 shows an exploded view of the connection element of FIG. 2.

The electrical connection element of the invention is shown in axonometric view in Figures from 1 to 3, where it is indicated as a whole by 1.

It can be noticed that it comprises a male thin connector 2 and a female thin connector 3, in which it is possible to identify a fork 4 suitable for the insertion of the male thin connector 3.

In particular, it can be observed that the fork 4 is provided with two shaped arms 5, 6 defining a slit 7 for the insertion through interference of the male thin connector 3, so that the electrical contact can be obtained.

According to the invention, a bridge element 8 connects the shaped arms 5, 6 with each other.

In particular, the bridge element 8 is associated with the ends 6*a*, 6*a* of the shaped arms 5, 6 and has a curved profile whose concave part ea is directed towards the slit 7.

It should also be noticed that the shaped arms 5, 6 and the female thin connector 3 in which they are obtained define a plane a from which the curved profile of the bridge element 8 projects, as shown in FIG. 1.

In this way, the bridge element 8 behaves like a leaf spring that deforms when the male thin connector 2 is inserted in the slit 7, thus keeping the shaped arms 5, 6 of the fork 4 forced against the male thin connector 2, thus guaranteeing contact.

The tightening force is thus produced by the combined effect of the intrinsic elasticity of the material of which the connectors are made, increased by the elastic thrust force due to the deformation of the bridge element 8 that, as already explained, acts as a leaf spring.

In order to make said tightening force generate a high tightening pressure, which is indispensable for an optimal electrical contact, the slit 7 is provided with an intermediate area 7*a* that is in contact with the male thin connector 2, said intermediate area 7*a* being defined by opposing shaped projections 9, 10, each one of which belongs to one of the shaped arms 5, 6 of the fork 4 and protrudes towards the inside of the slit 7.

The limited extension of the contact areas of the shaped projections 9, 10 with the male thin connector 2 ensures; in fact, said high contact pressure.

The tightening effect obtained is at least comparable with the effect that can be observed in the known connection elements with thin connectors provided with steel elastic elements.

It is evident that the shape of the bridge element 8 and its dimensions will be chosen in such a way as to guarantee a contact force sufficient to satisfy the customer's needs.

It is also evident that in order to obtain a coupling through interference between the thin connectors 2 and 3, the distance 7*b* between the shaped projections 9, 10 present in the shaped arms 6, 6 that defines the width of the intermediate area 7*a* must be shorter than the thickness 2*a* of the male thin connector 2.

Also the distance 7*b* between the shaped projections 9, 10 will be selected based on the thickness 2*a* of the male thin connector 2, in such a way as to guarantee the degree of interference that produces the optimal electrical contact.

The connection element of the invention makes it possible to carry out the electrical connection shown in Figures from 4 to 8, where it is indicated as a whole by 20, and comprising a single connection element 21 in which the male thin connector 22 and the female thin connector 23 are provided with means 24 for connection to electrical wires, respectively A and B, as shown in Figures from 6 to 8.

Figure 4:
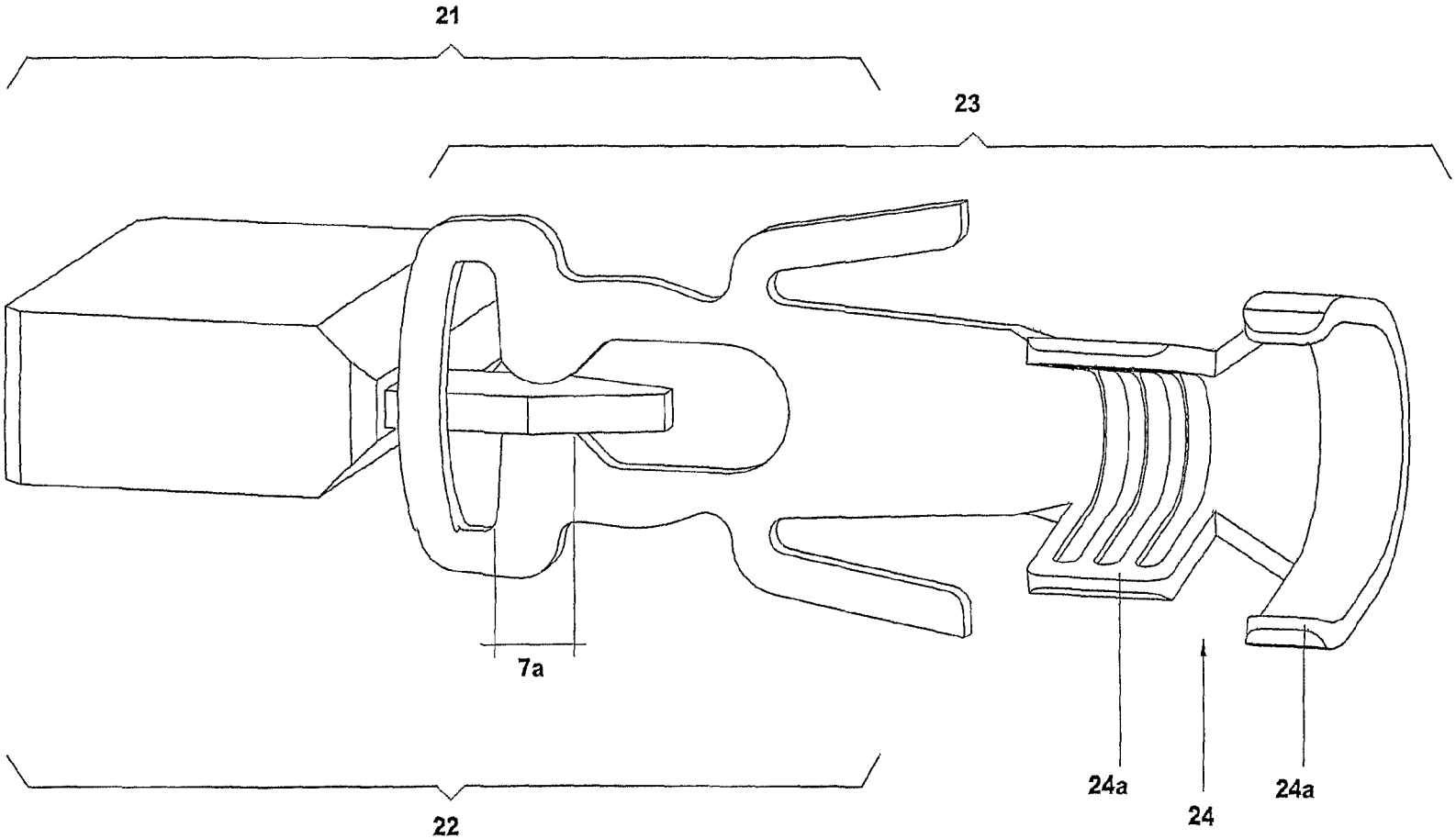
FIG. 4 shows the axonometric view of a first embodiment of an electrical connection using a connection element carried out according to the invention.
Figure 5:
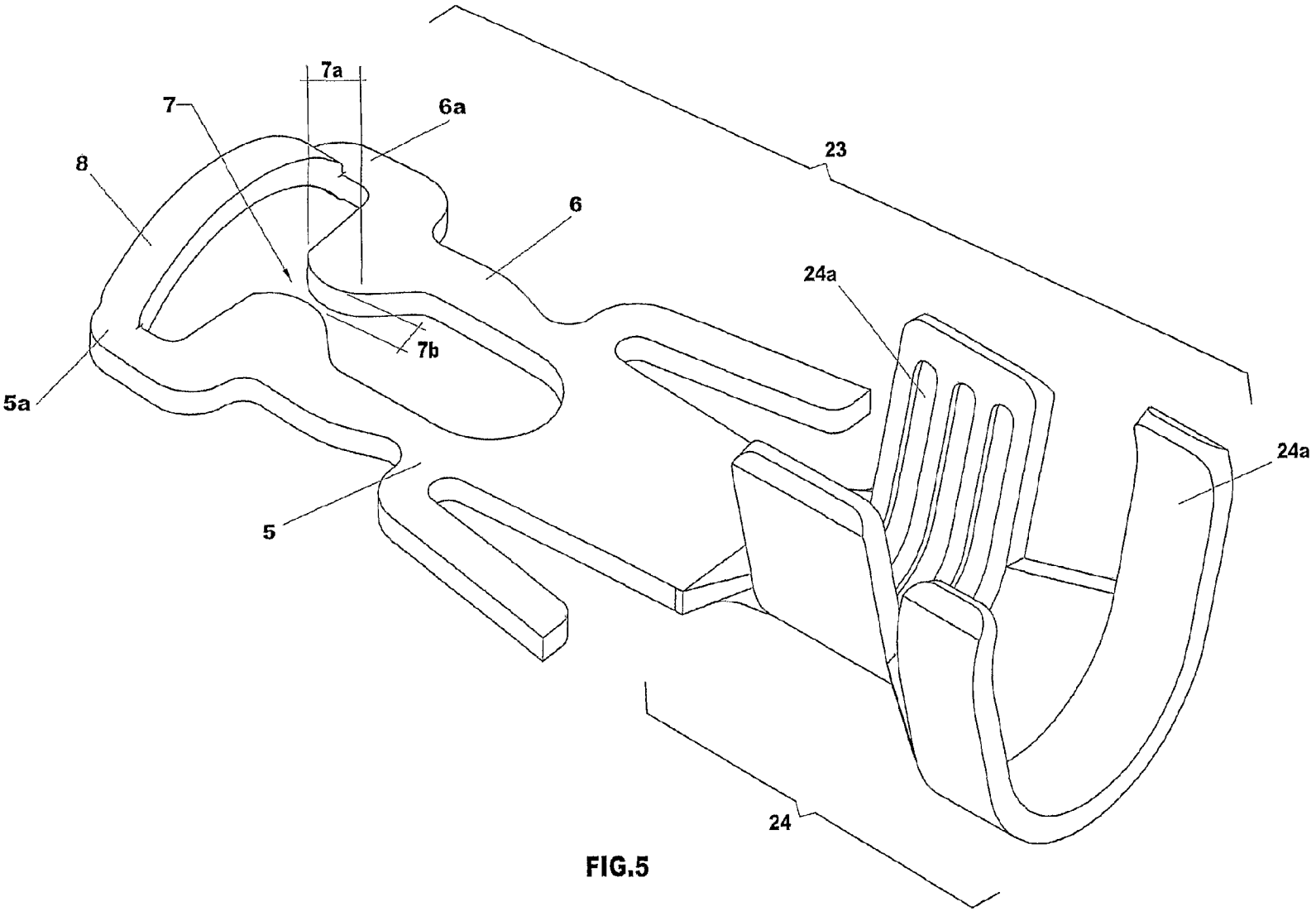
FIG. 5 shows a detail of the electrical connection shown in FIG. 4.
Figure 6:
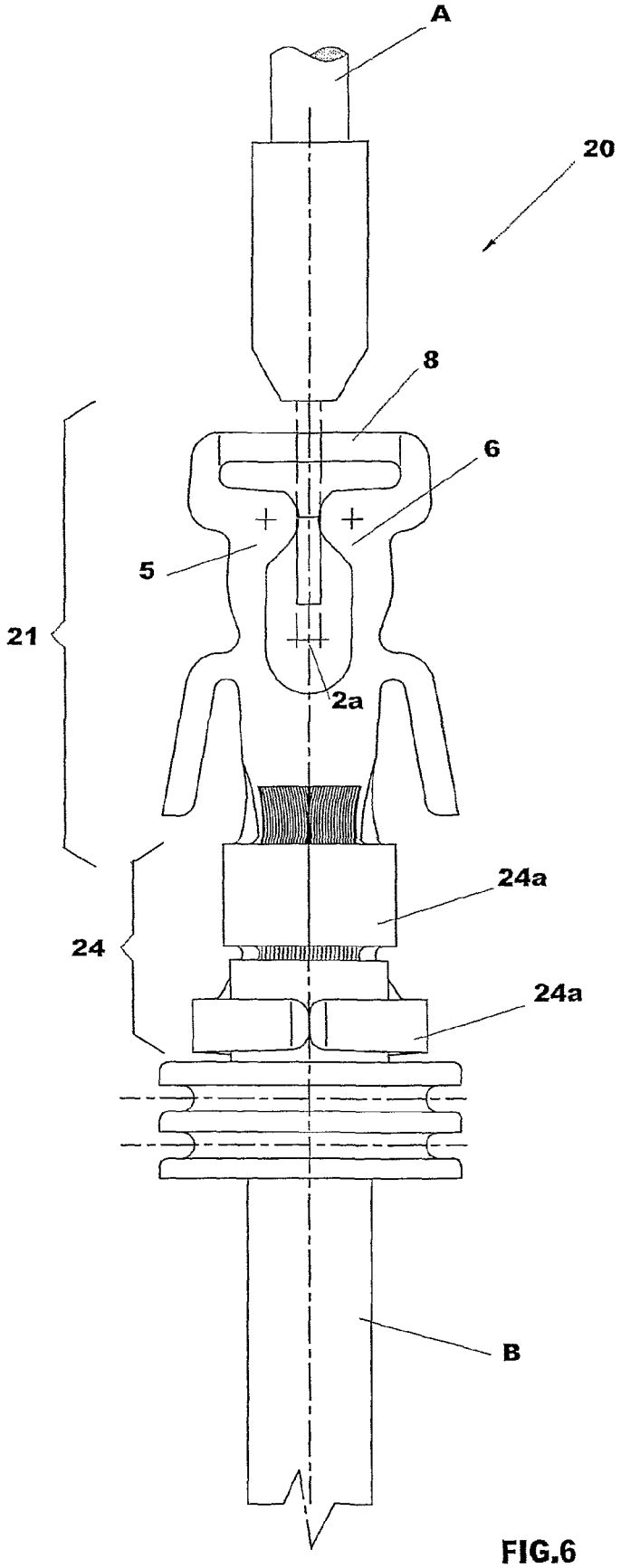
FIG. 6 shows a view of the electrical connection shown in FIG. 4.
Figure 7:
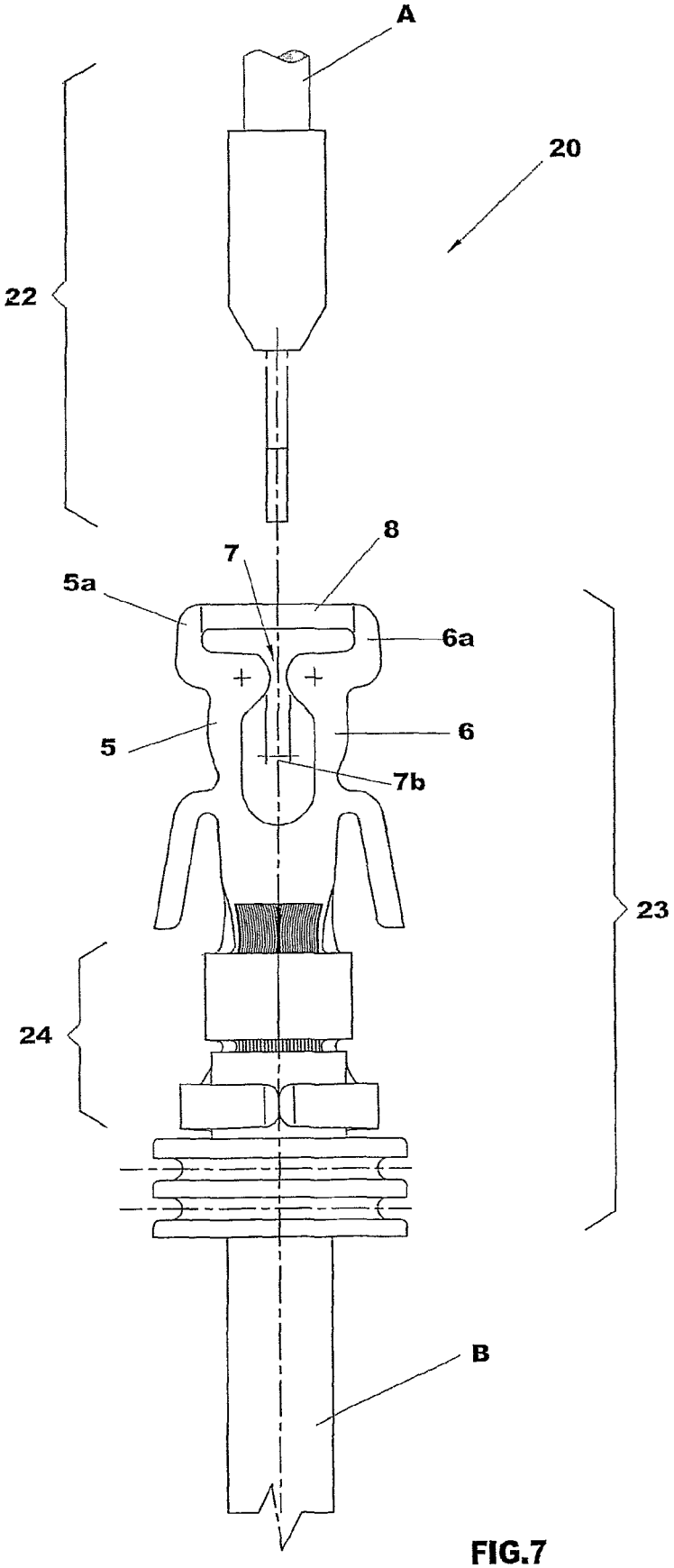
FIG. 7 shows the electrical connection of FIG. 6 when disassembled.
Figure 8:
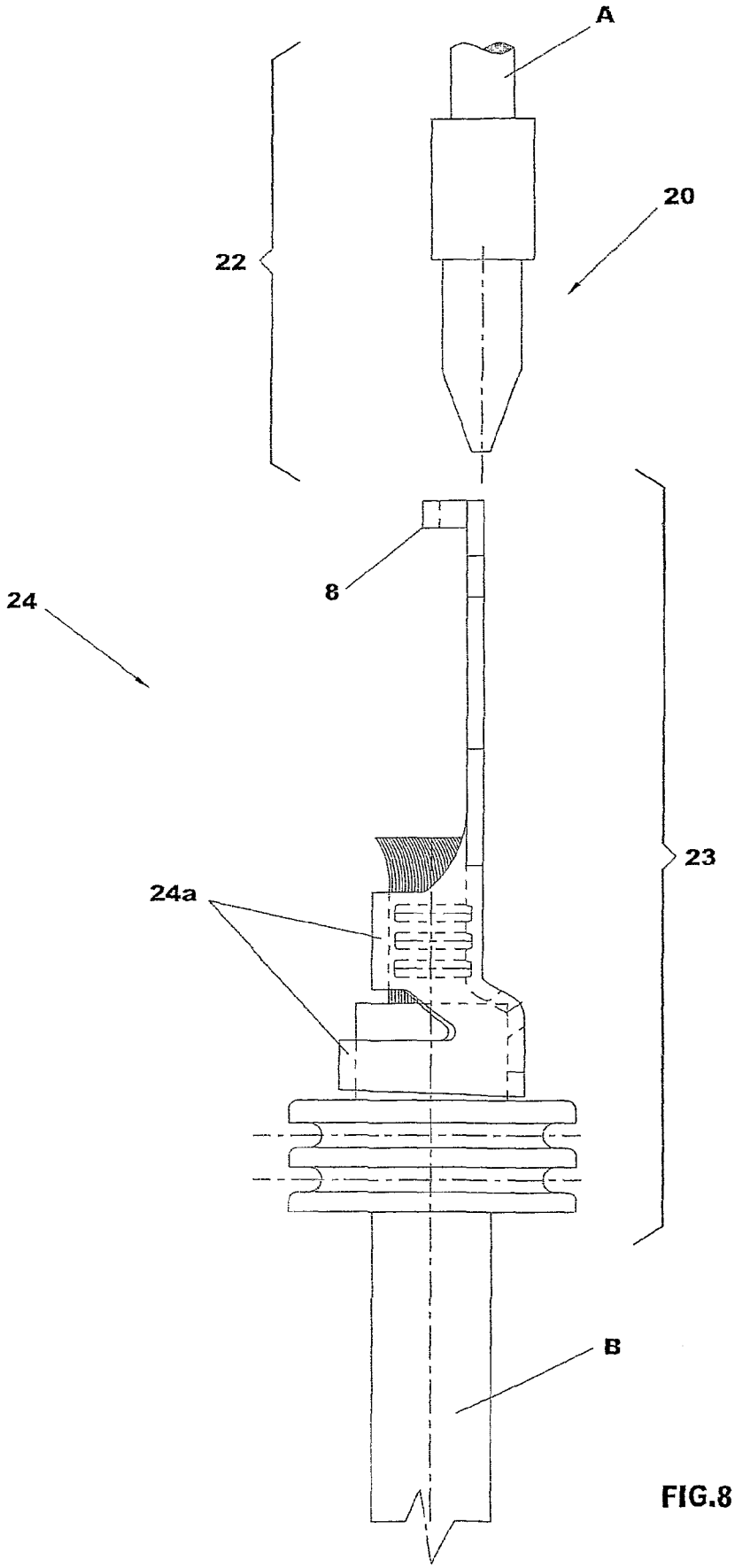
FIG. 8 shows another view of the electrical connection shown in FIG. 7.

In particular, the means 24 for connection to the electrical wires are of the type known per se, for example crimping blades 24*a* that are represented by way of example in FIGS. 4 and 5 and are associated with the female thin connector 23.

Furthermore, the thin connectors 22, 23 will be housed in insulating casings having any construction form and not represented herein, suited to maintain the alignment between the thin connectors 22, 23 when they are coupled to each other.

The connection element 20 allows electric continuity between the leads A and B to be achieved.

Figure 9:
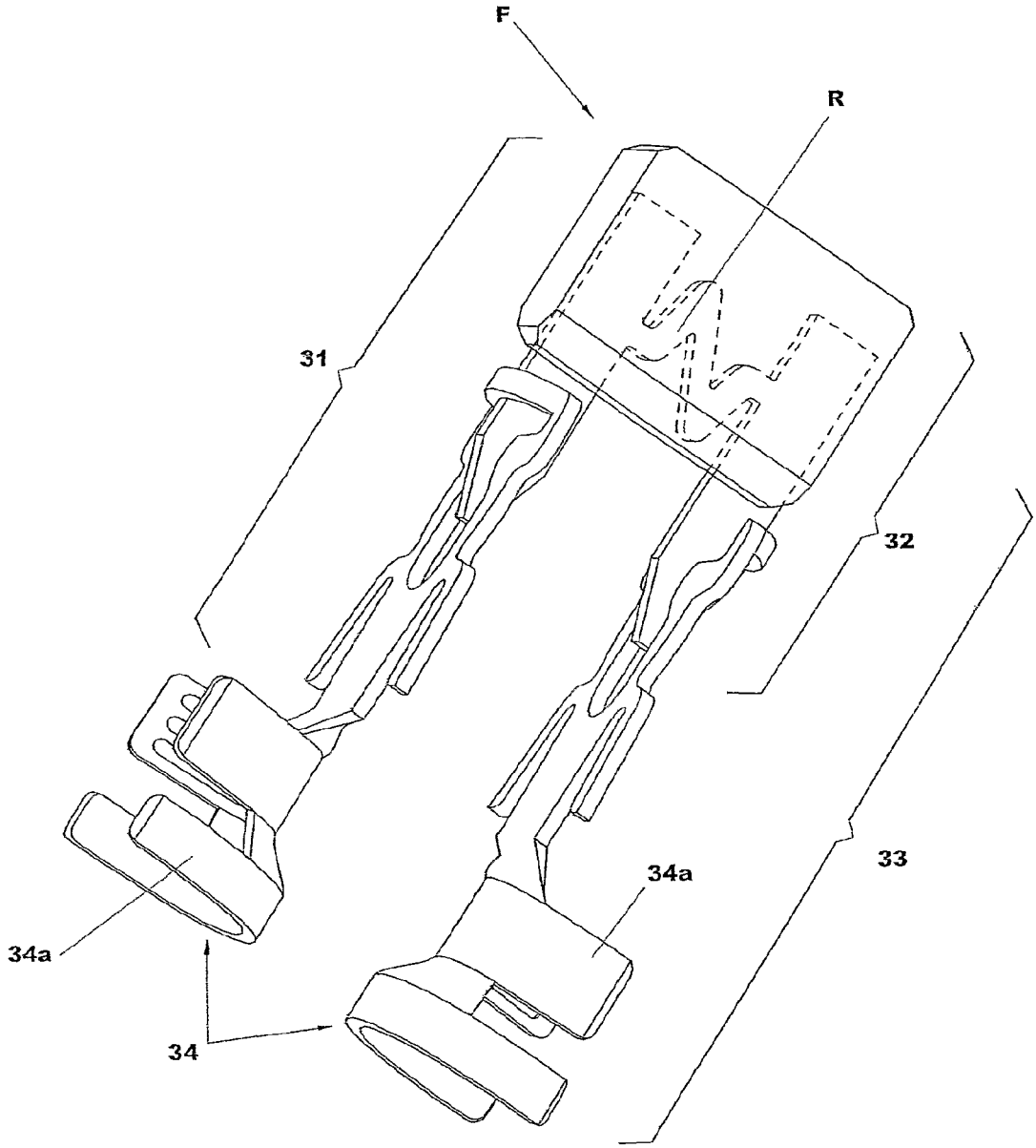
FIG. 9 shows the axonometric view of another embodiment of the electrical connection that is the subject of the invention.
Figure 10:
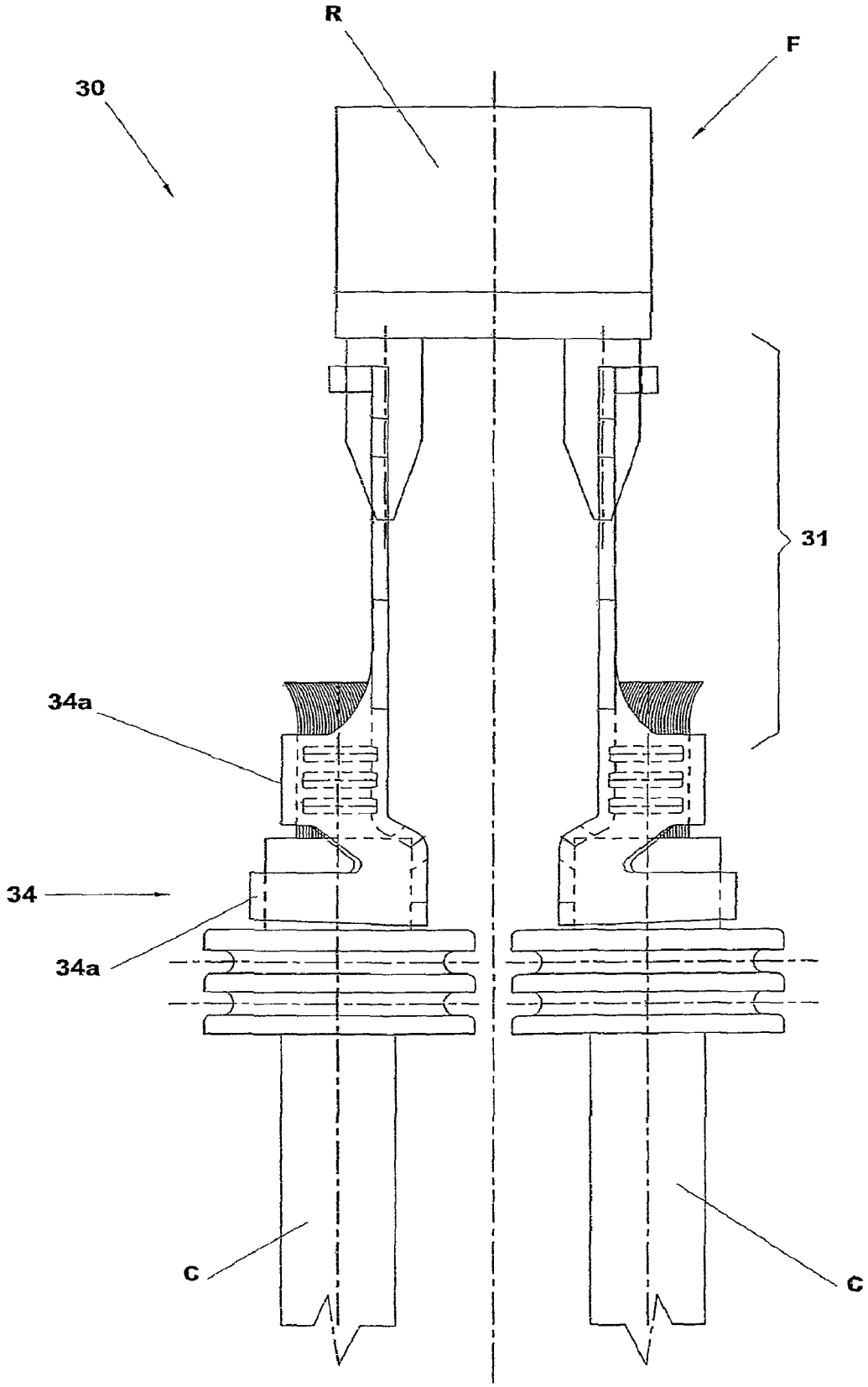
FIG. 10 shows a view of the electrical connection shown in FIG. 9.

The connection element that is the subject of the invention makes it possible to carry out also another embodiment of the electrical connection of the invention, which is illustrated in FIGS. 9 and 10, where it is indicated as a whole by 30.

It should be noticed that it comprises one pair of connection elements 31 in which each of the two female thin connectors 33 is provided with means 34 for connection to electrical wires C, for example crimping blades 34*a*, while the two male thin connectors 32 are electrically connected to each other via a resistive element R, so that the resistive element R and the pair of male thin connectors 32 make up a fuse F.

This construction variant is thus particularly suited to make connections with fuse that are used especially in the automobile sector.

According to the above, it is clear that the electrical connection element and the electrical connections that can be made it, which are both subjects of the present invention, achieve all the set objects.

In particular, as already explained, the presence of the bridge element 8 that substantially acts as a leaf spring guarantees, with its elasticity, a contact force between the shaped arms 5, 6 of the fork 4 and the male thin connector 2, said contact force being at least equal to the force that is obtained in thin connection elements of known type provided with a steel elastic element that serves as a spring.

Furthermore, the invention also offers another advantage lying in that the presence of the bridge element 8 maintains the elasticity of the fork 4 and therefore the contact pressure between the thin collectors substantially constant over time.

The invention also achieves another object represented by the fact that, as the connection element is made in a single piece, it can be obtained by applying the same shearing and bending techniques used in the known solutions.

In the construction stage, the electrical connection element and the connections that can be obtained with it can undergo changes and modifications that are neither described herein nor illustrated in the drawings.

It is understood, however, that said changes or construction variants must all be considered protected by the present patent, provided that they fall within the scope of the claims expressed below.

The invention claimed is:

1. Electrical connection comprising:

a single electrical connection element that comprises:

a male thin connector;

a female thin connector in which it is possible to identify a fork having two shaped arms that define a slit for the insertion of said male thin connector in order to obtain the electrical contact, wherein the shaped arms are provided with opposing shaped projections belonging to each one of said shaped arms of said fork and protruding towards the inside of said slit where they define, together with said projections and both with the male thin connector disconnected and with the male thin connector connected, a plane, and are provided with a bridge element that connects said shaped arms with each other, wherein said bridge element projects with respect to the plane, behaving like a leaf spring and keeping the shaped arms of the fork forced against the male thin connector, wherein said male thin connector and said female thin connector are provided with means for connection to at least one electric cable, and wherein said connection means are crimping elements.

2. Electrical connection according to claim 1, wherein said bridge element connects said shaped arms with each other at the level of their ends.

3. Electrical connection according to claim 1, wherein said bridge element has a curved profile with the concave part facing toward said slit.

4. Electrical connection according to claim 1, wherein at least one of said thin connectors is at least partially housed in an insulating case.

5. Electrical connection according to claim 1, wherein at least one of said thin connectors is at least partially housed in an insulating case.

6. Electrical connection according to claim 1, wherein each shaped arms of said fork substantially behaves like a beam resting on ends constituted by a body of the female thin connector on one side and by the bridge element on another side, loaded in an intermediate area at level of each shaped projection.

7. Electrical connection according to claim 1, wherein each shaped arms of said fork substantially behaves like a beam resting on ends constituted by a body of the female thin connector on one side and by the bridge element on another side, loaded in an intermediate area at a level of each shaped projection.

8. Electrical connection according to claim 1, wherein said slit it is possible to identify at least one intermediate area of contact with said male thin connector, said intermediate area being defined by opposing shaped projections belonging to each one of said shaped arms of said fork and protruding towards the inside of said slit.

9. Electrical connection element according to claim 8, wherein a distance between said shaped projections, defines a width of said intermediate area of contact and is shorter than a thickness of said male thin connector with which said intermediate area generates a coupling by interference.

10. Electrical connection comprising two electrical connection elements carried out according to claim 1, wherein each one of said female thing connectors is provided with means for connection to at least one electric cable and said male thing connectors are electrically connected to each other via a resistive fuse element.

11. Electrical connection according to claim 10, wherein at least said male thin connector are at least partially housed in an insulating case that contains also said resistive fuse element.

12. Electrical connection comprising two electrical connection elements wherein each said electrical connection element comprises:

a male thin connector;

a female thin connector in which it is possible to identify a fork having two shaped arms that define a slit for the insertion of said male thin connector in order to obtain the electrical contact, wherein the shaped arms are provided with opposing shaped projections belonging to each one of said shaped arms of said fork and protruding towards the inside of said slit where they define, together with said projections and both with the male thin connector disconnected and with the male thin connector connected, a plane, and are provided with a bridge element that connects said shaped arms with each other, wherein said bridge element projects with respect to the plane, behaving like a leaf spring and keeping the shaped arms of the fork forced against the male thin connector, and wherein each one of said female thin connectors is provided with means for connection to at least one electric cable and said male thin connectors are electrically connected to each other via a resistive fuse element.

13. Electrical connection according to claim 12, wherein at least said male thin connectors are at least partially housed in an insulating case that contains also said resistive fuse element.

14. Electrical connection according to claim 12, where said bridge element connects sais shaped arms with each other at the level of their ends.

15. Electrical connection according to claim 12, wherein said bridge element has a curved profile with the concave part facing toward said slit.

16. Electrical connection according to claim 12, wherein said slit it is possible to identify at least one intermediate area of contact with said male thin connector, said intermediate area being defined by opposing shaped projections belonging to each one of said shaped arms of said fork and protruding towards the inside of said slit.

17. Electrical connection according to claim 16, wherein a distance between said shaped projections defines a width of said intermediate area of contact and is shorter than a thickness of said male thin connector with which said intermediate area generates a coupling by interference.

18. Electrical connection comprising a single electrical connection element carried out according to claim 12, wherein said male thin connector and said female thin connector are provided with means for connection to at least one electric cable.

19. Electrical connection according to claim 18, wherein at least one of said thin connectors is at least partially housed in an insulating case.

20. Electrical connection according to claim 18, wherein said connection means are crimping elements.

21. Electrical connection according to claim 20, wherein at least one of said thin connectors is at least partially housed in an insulting case.

* * * * *